US006135820A

United States Patent [19]

Chiang

[11] Patent Number: 6,135,820

[45] Date of Patent: Oct. 24, 2000

[54] CONDUCTIVE ELECTRODE STRUCTURE FOR DOUBLE-SIDED MULTI-SOCKET ADAPTER PANEL

[75] Inventor: Yi-Te Chiang, Taipei, Taiwan

[73] Assignee: Primax Electronics Ltd., Taipei Hsien, Taiwan

[21] Appl. No.: 09/035,195

[22] Filed: Mar. 5, 1998

[30] Foreign Application Priority Data

Dec. 17, 1997 [TW] Taiwan ..... 86220959

[51] Int. Cl.[7] ..... H01R 25/00

[52] U.S. Cl. ..... 439/654

[58] Field of Search ..... 439/652, 215, 439/501, 214

[56] References Cited

U.S. PATENT DOCUMENTS

| | | | |
|---|---|---|---|
| 3,353,137 | 11/1967 | Miller | 439/654 |
| 4,729,741 | 3/1988 | Peng | 439/654 |
| 4,867,701 | 9/1989 | Wiand | 439/501 |
| 4,979,907 | 12/1990 | Lee | 439/214 |
| 5,272,587 | 12/1993 | Wan | 361/111 |
| 5,526,225 | 6/1996 | Wang | 439/650 |
| 5,658,158 | 8/1997 | Milan | 439/652 |
| 5,971,808 | 10/1999 | Chiang et al. | 439/654 |
| 9,048,377 | 3/1998 | Chiang et al. . | |

*Primary Examiner*—Lincoln Donovan
*Assistant Examiner*—Javaid Nasri

[57] ABSTRACT

A conductive electrode structure for a double-sided multi-socket adapter panel comprising a live conductive electrode bar and a neutral conductive electrode bar that provides the optimal number of plugging sockets as well as distance of separation for neighboring plugging sockets. Furthermore, the plugging sockets in each side of the adapter panel are oriented in such a way that all the live and neutral plugging slots are aligned in a row, thereby eliminating undesirable interference from neighboring plugging cables. In addition, some of the plugging sockets are spaced so far apart that even a large plug from a transformer adapter can be plugged without affecting plugging sockets in its neighborhood.

8 Claims, 9 Drawing Sheets

CONDUCTIVE ELECTRODE STRUCTURE FOR DOUBLE-SIDED MULTI-SOCKET ADAPTER PANEL

CROSS-REFERENCE TO RELATED APPLICATION

This application claims priority benefit of parent U.S. patent application No. 09/048,377 filed Mar. 26, 1998 which became issued U.S. Pat. No. 5,971,808 which in turn claims priority benefit of Taiwan application serial no. 86220959, filed Dec. 17, 1997, the full disclosure of which is incorporated by reference.

BACKGROUND OF THE INVENTION

1. Field of Invention

The present invention relates to a double-sided multi-socket adapter panel design. More particularly, the present invention relates to the design of a conductive electrode for a double-sided multi-socket adapter panel.

2. Description of Related Art

Most adapter panel designs have a number of plugging sockets. There are two main types of adapters in the market nowadays. One type of adapter panel is for plugging into a power source directly in order to increase the number of plugging positions. The second type of adapter panel includes a plug and an extension cable. The former type of adapter is plunged directly into a power source socket. Due to weight and size, the maximum number of plugging positions for this type of adapter is quite limited. However, for the latter type of adapter panel, there are virtually no limits to the number of plugging sockets. Ease of management and its ability to satisfy all plug-in requirements at one time makes this type of socket very popular for plugging computer systems and its peripheral components.

Despite the extensive use of a multi-socket type of adapter panel with an extension cable, inconveniences are often found in actual applications. For example, from a user's point of view, as many sockets as possible should be packed into an adapter panel. In practice, there are an optimal number of sockets to be available for each adapter panel considering factors such as its volume, weight and cost. In general, the maximum number of sockets is around six. Therefore, to increase the number of sockets for an adapter panel having a given length and a given volume, or alternatively, to reduce the amount of material used or production cost, a single-sided multi-socket adapter panel would be unsatisfactory. Consequently, the concept of a double-sided multi-socket adapter panel is initiated, for example, as in U.S. Pat. No. 5,232,381.

FIG. 1 is a split-opened perspective view of a conventional double-sided multi-socket adapter panel. Design similar to the one shown in FIG. 1 is now available in the market. As shown in FIG. 1, what makes a double-sided multi-socket adapter panel 10 possible is the innovative design of a conductive electrode bar 12. The conductive electrode bar 12 does not occupy too much space and uses very little material.

However, a number of limitations in the design make the applications of this type of double-sided multi-socket panel rather unsatisfactory. Firstly, a number of data processing products require power transformer adapter whose plugging head is especially large. Hence, once such an adapter is plugged into a socket, its neighboring sockets are impossible to use leading to a drop in the number of actual socket positions that are available. In view of this, it is preferable to have a design that can accommodate larger plugging head but without affecting the distribution of plugging sockets or the material and production cost. Secondly, the respective electrode plugging slots 16*a* and 16*b* of sockets 14 in a conventional panel are aligned into two separate rows. In other words, the sockets are arranged such that the plugging slots 16*a* are aligned as a row at the bottom while the plugging slots 16*b* are aligned as a row at the top as shown in FIG. 1. This type of plugging socket orientation may result in some interference with neighboring sockets when a socket is plugged, and is especially serious when a large-size plug such as a power transformer adapter (most power transformer plug is somewhat elongated in a direction parallel to the row of plugging slots 16*a* or 16*b*) is engaged. On the other hand, if a plug 20 whose cable 22 forms a 90° bent with the electrode pins 24 as shown in FIG. 2 is used, spatial occupation in a vertical direction above the socket is minimized. However, problem such as the interference with neighboring sockets is intensified. Hence, if each socket 14 can be turned 90° from the directions of the row of plugging slots 16*a* (or 16*b*) so that a vertically oriented socket is obtained (called a vertical socket from now on), the above problem can be solved. FIG. 3 is a split-opened perspective view of a conventional vertical socket double-sided multi-socket adapter panel. The conductive electrode bar 32 is a structure that consumes a little more material, but somehow can align the electrode plugging slots 36*a* and 36*b* of sockets 34 in a row so that the plug forms a 90° angle with the plug-in position of the aforementioned socket 14 as shown in FIG. 1. Yet, the double-sided multi-socket adapter panel shown in FIG. 3 is still not an optimal system. If the conductive electrode bar 32 of FIG. 3 is used as a basis for forming double-sided multi-socket adapter panel, more material is needed or distance between sockets has to be shortened compared with the conductive electrode bar 12 design of FIG. 1. Therefore, a greater cost of production is incurred.

In light of the foregoing, there is a need to provide an optimal design for a double-sided multi-socket adapter panel whose electrode plugging slots are aligned in a row.

SUMMARY OF THE INVENTION

Accordingly, the present invention is to provide a conductive electrode bar structure for a double-sided multi-socket adapter panel such that the optimal number of plugging sockets and suitable separation between sockets are obtained. Moreover, the double-sided multi-socket adapter panel is designed not only to accommodate large-sized plug such as a transformer adapter without interfering with other plugging positions, but the electrode plugging slots are also aligned in a row so that plugs can be plugged into the socket in a vertical direction.

To achieve these and other advantages and in accordance with the purpose of the invention, as embodied and broadly described herein, the invention provides a conductive electrode bar structure for a double-sided multi-socket adapter panel. Each side of the adapter panel has a plurality of plugging sockets, wherein each plugging socket's two electrode plugging slots are aligned in a row. Furthermore, some of the plugging sockets are separated far enough from each other so that even the plug of a transformer adapter can be accommodated without interfering with neighboring plugging sockets. The conductive electrode bar structure comprises: a live conductive electrode bar, fitted inside the double-sided adapter panel and included a plurality of live electrode plates such that each live plugging slot position in each plugging socket has a live electrode plate in it, the live electrode plate is a structure having two side strips and a central bulging section enclosing a hollow, which is formed by a punching operation, and that the live plugging pin of a plug can fit perfectly inside the central hollow of the live electrode plate in order to achieve proper electrical contact; and a neutral conductive electrode bar also fitted inside the double-sided adapter panel and included a plurality of neutral electrode plates whose function and shape are exactly the same as the live electrode plates, and so the neutral plugging pin of a plug can fit perfectly inside the central hollow of the neutral electrode plate in order to achieve proper electrical contact.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
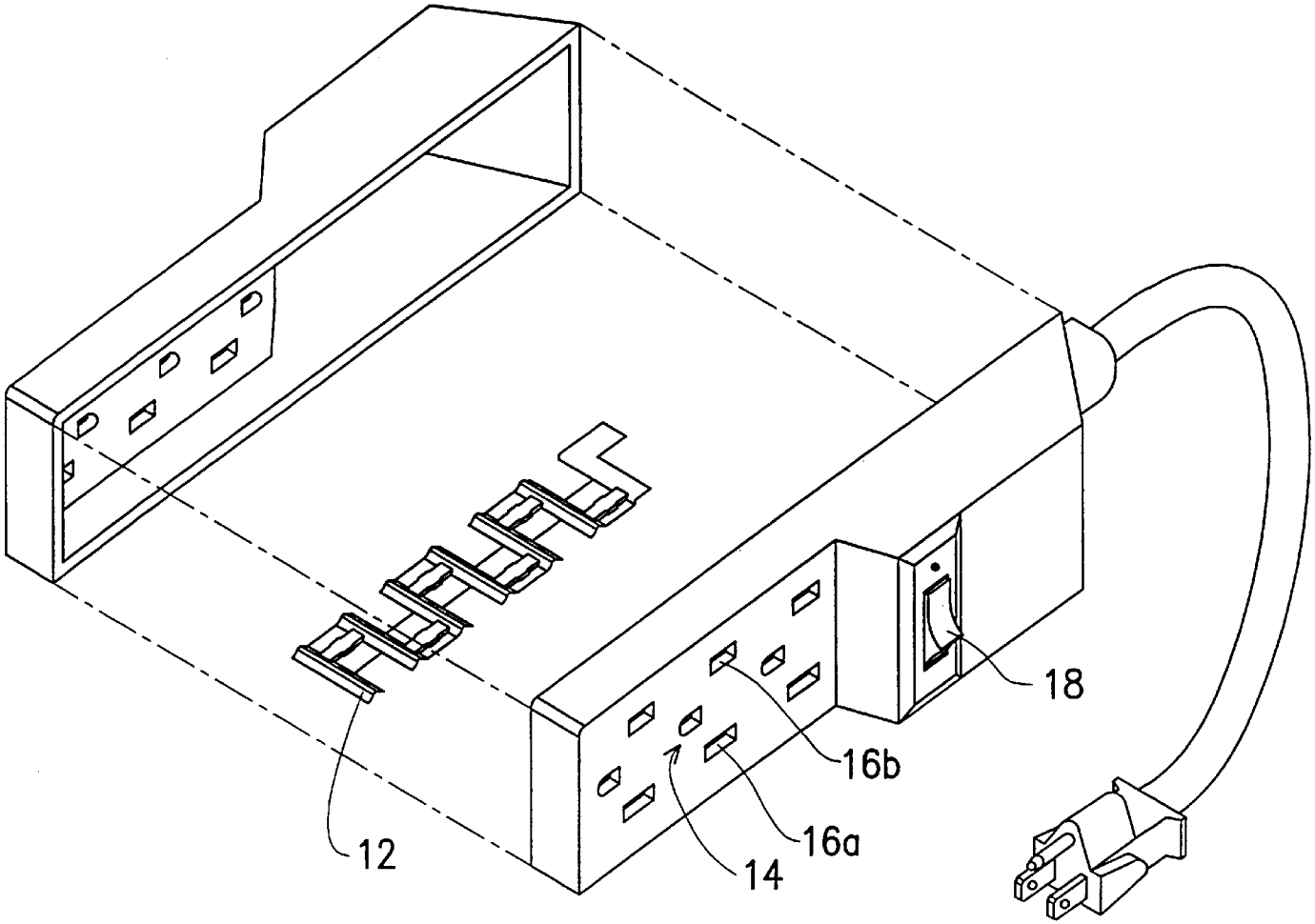
FIG. 1 (PRIOR ART)
FIG. 1 is a split-opened perspective view of a conventional double-sided multi-socket adapter panel.

Reference will now be made in detail to the present preferred embodiments of the invention, examples of which are illustrated in the accompanying drawings. Wherever possible, the same reference numbers are used in the drawings and the description to refer to the same or like parts.

Figure 4A:
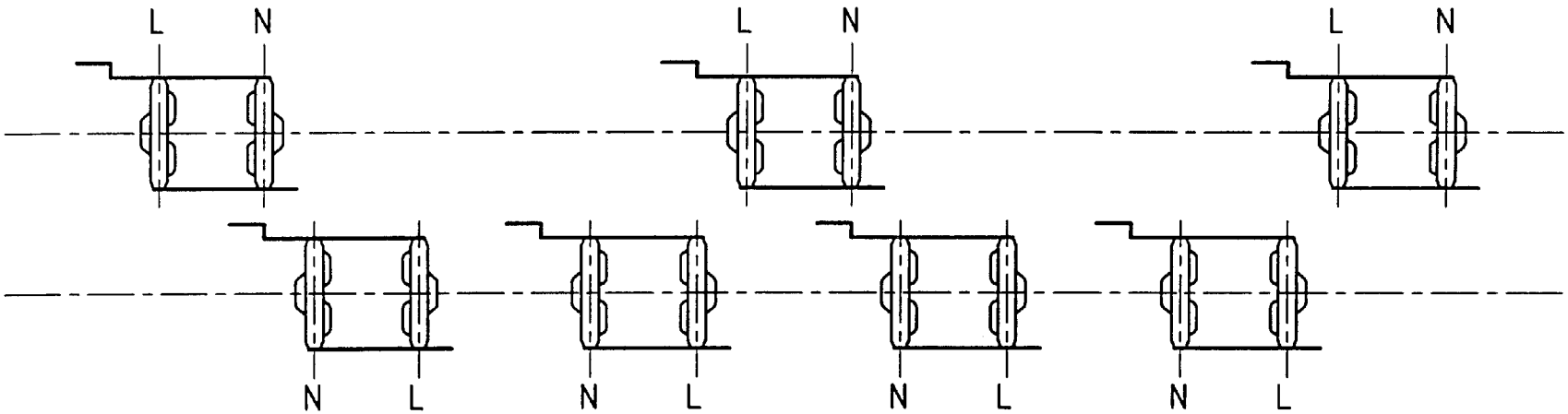
FIGS. 4*a* through 4*c* are schematic views showing the design flow of a conductive electrode bar according to the embodiment of this invention.
Figure 4B:
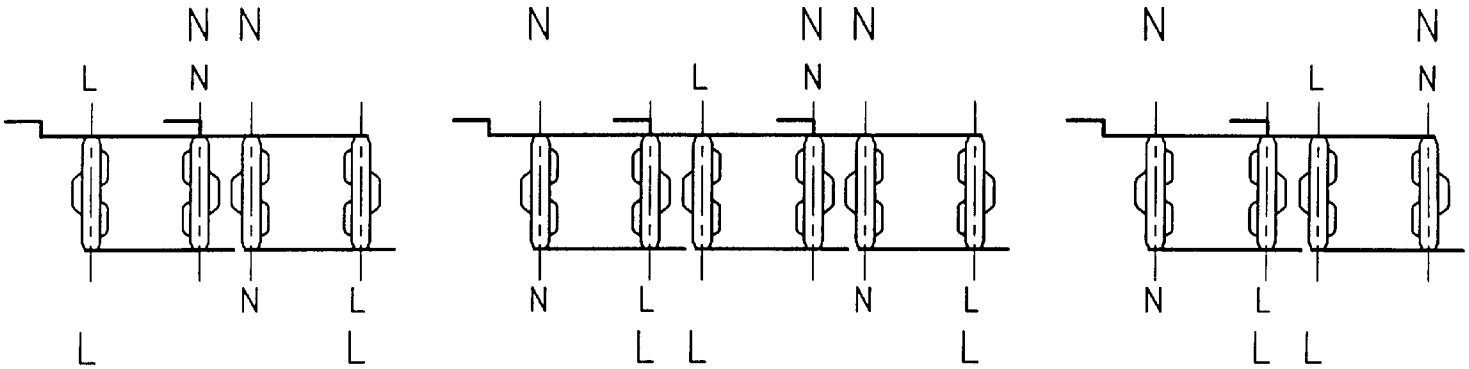
Figure 4C:
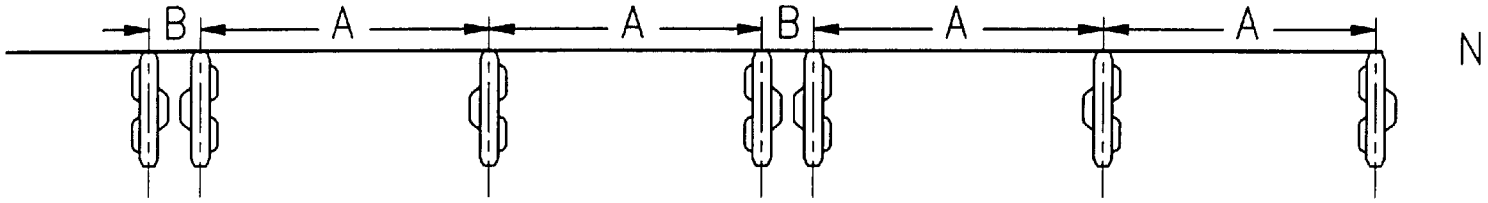
Figure 4C:
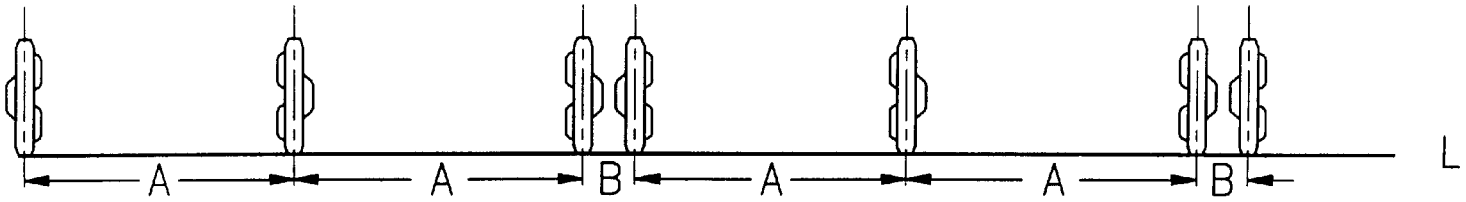

FIGS. 4*a* through 4*c* are schematic views showing the design flow of a conductive electrode bar according to the embodiment of this invention. In FIG. 4*a*, the components labeled L and N represent a plugging slot for live connection and a plugging slot for neutral connection respectively (plugging slot for earth connection is not shown). Therefore, this double-sided multi-socket adapter panel design comprises a group of three widely separated vertical plugging sockets (not drawn) on one side of the panel and four moderately separated vertical plugging sockets (not drawn) on the other side of the panel. In FIG. 4*b*, all the seven pairs of plugging sockets are combined together to form a double-sided plugging socket layout diagram. Then, in FIG. 4*c*, all the live connections are separated from the neutral connections, and then re-grouped together to form the layout design for the live conductive electrode bar and the neutral conductive electrode bar respectively. Hence, the fabrication of the live conductive electrode bar and the neutral conductive electrode bar can be carried out. Structurally, both the live conductive electrode bar and the neutral conductive electrode bar are very similar, and so similar methods of fabrication can be employed.

Figure 3:
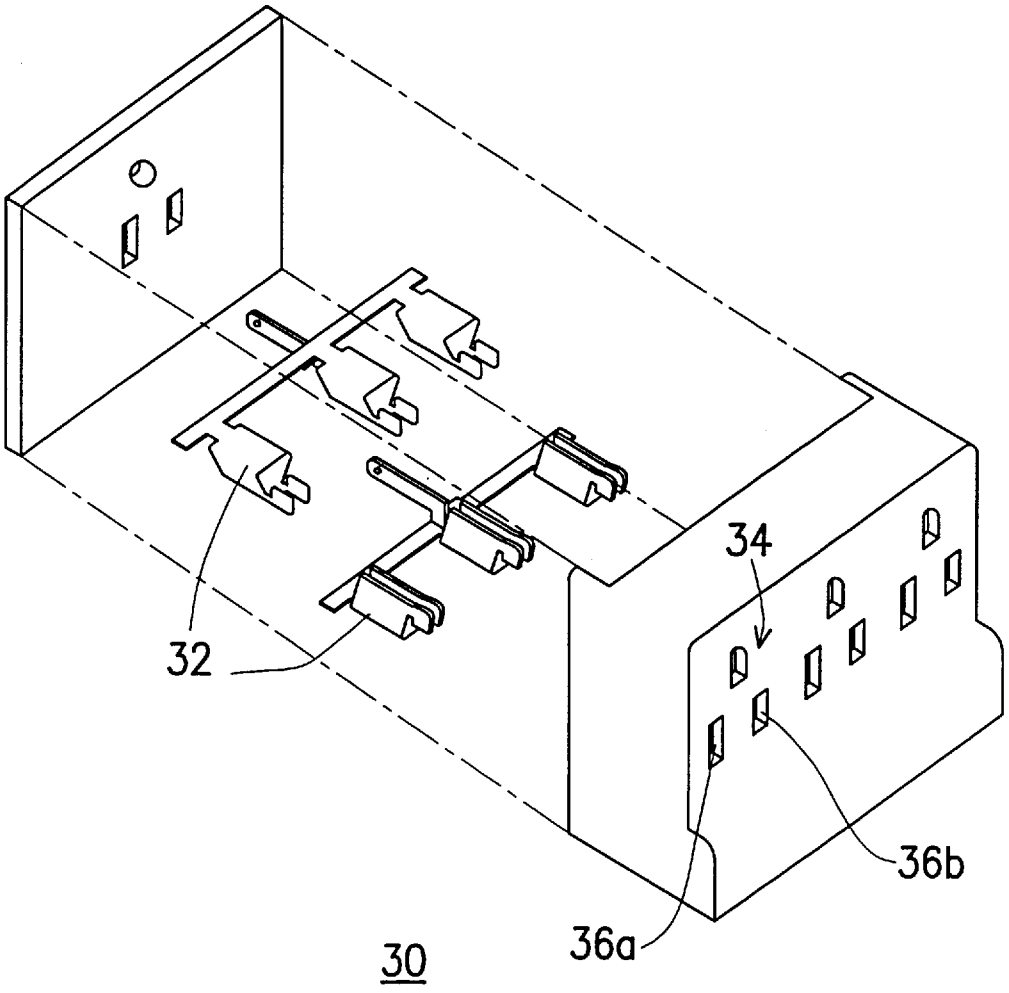
FIG. 3 (PRIOR ART)
FIG. 3 is a split-opened perspective view of a conventional vertical socket double-sided multi-socket adapter panel.
Figure 5:
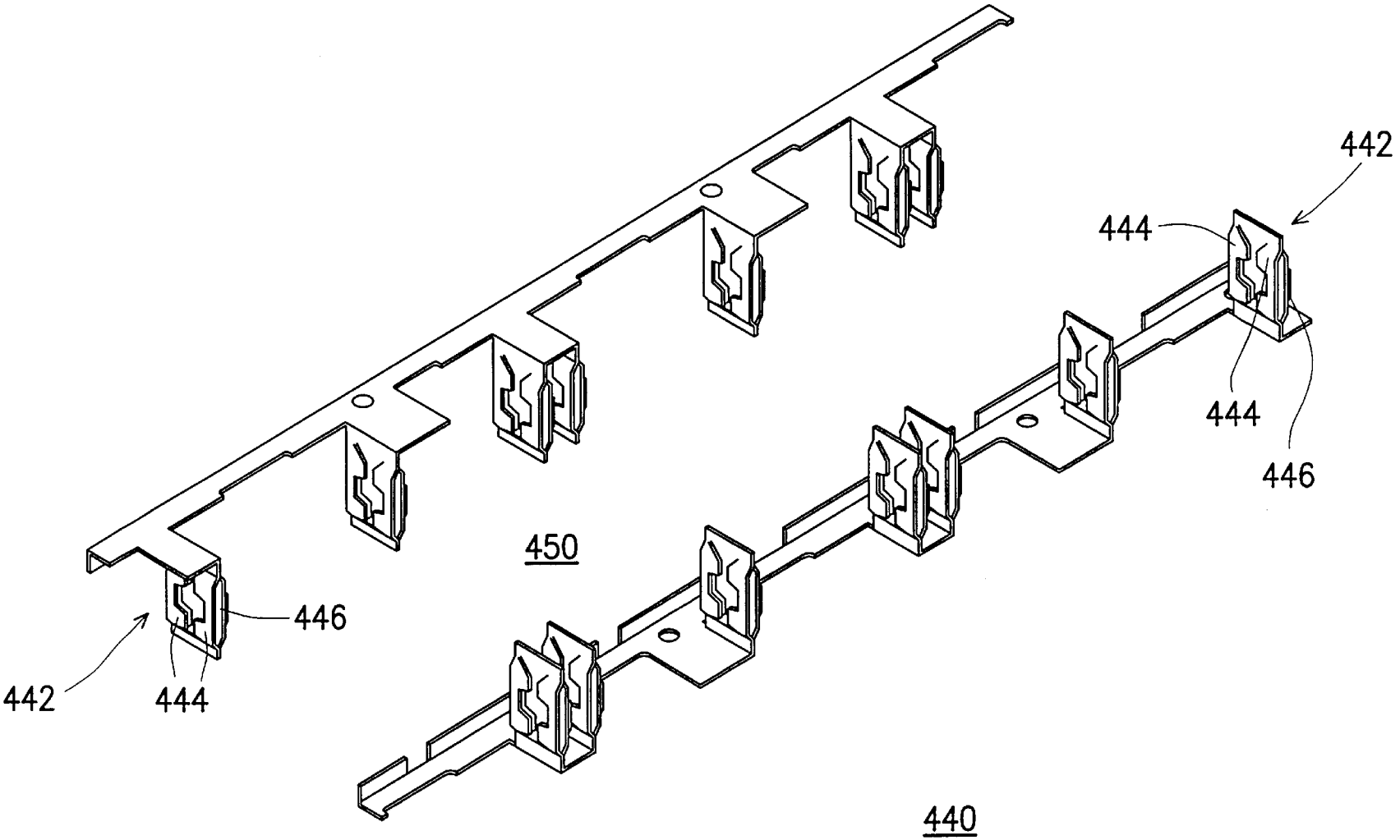
FIG. 5 is a perspective view showing the conductive electrode bar according to the design of this invention.

FIG. 5 is a perspective view showing the conductive electrode bar according to the design as shown in FIG. 4*c* of this invention. In FIG. 5, a live conductive electrode bar 440 and a neutral conductive electrode bar 450 are shown. The design here uses a similar design concept as in the design of a conductive electrode bar 12 as described in FIG. 1. The live and the neutral conductive electrode bars 440 and 450 comprises a number of live and neutral conductive electrode plates 442, all having the same structure. Each conductive electrode plate 442 has two side strips 444 and a central bulging section 446 enclosing a hollow, and that a live plugging pin of a plug (not drawn) can fit perfectly inside the central hollow created by the central bulging section 446 and the two side strips 444 of an electrode plate for achieving proper electrical contact. Steps necessary for fabricating these conductive electrode plates 442 is quite simple. The production only requires bending one side of the conductive electrode, and then punching with a punching-press to form the central bulging section 446. The conductive electrode plates are particularly suitable for fitting inside a double-sided vertical plugging socket type of construction due to its symmetrical nature. On the other hand, compared with the fabrication of a similar structure in a conductive electrode bar 32 as shown in FIG. 3, the two sides have to be bent in order to form a clip-shaped structure. Hence, production cost can be saved and the conductive electrode bar structure is much easier to implement.

Figure 6:
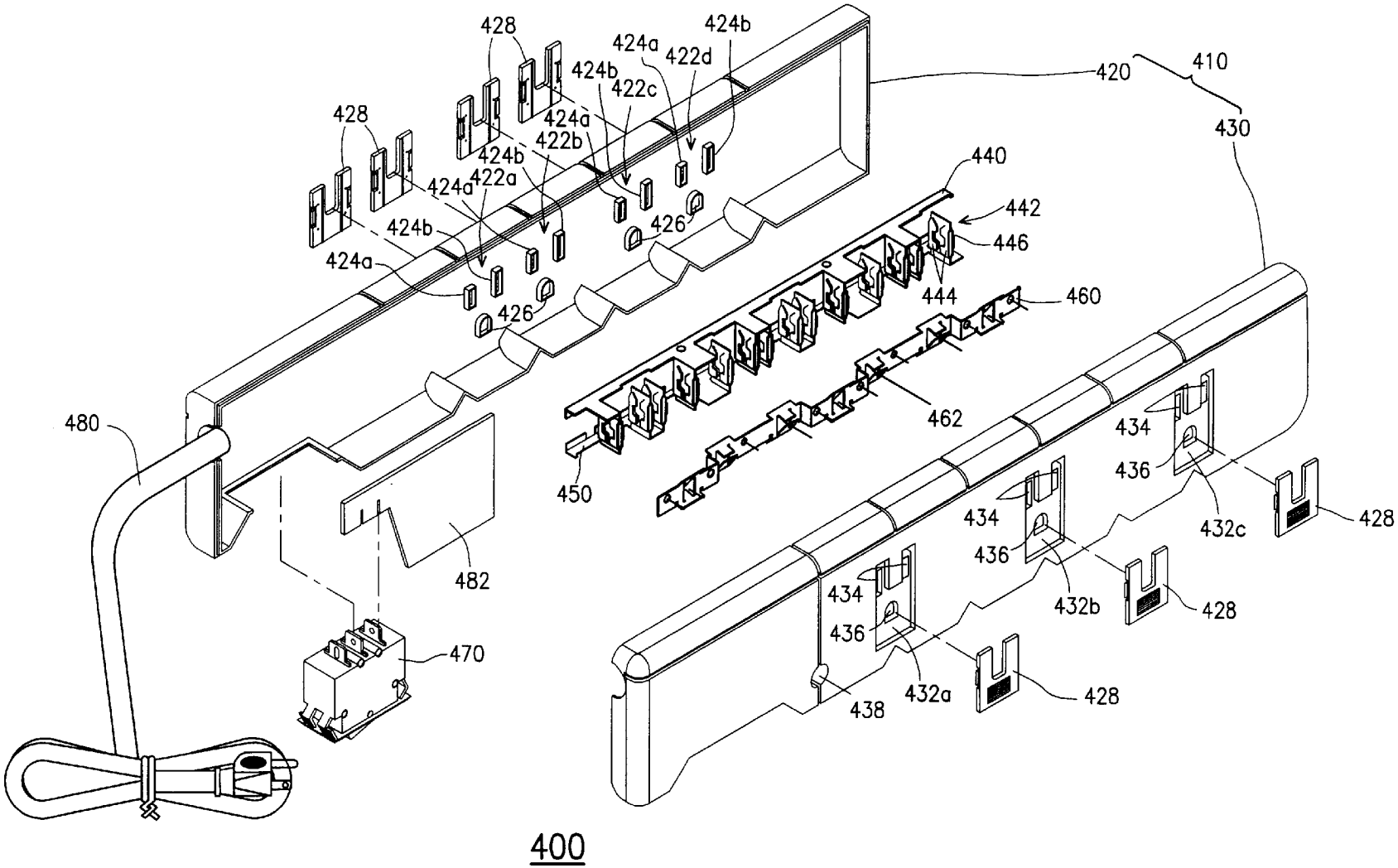
FIG. 6 is an explosive view showing all the components of a double-sided multi-socket adapter panel that incorporates a conductive electrode bar design according to the preferred embodiment of this invention.

FIG. 6 is an explosive view showing all the components of a double-sided multi-socket adapter panel that incorporates a conductive electrode bar design according to the preferred embodiment of this invention. In FIG. 6, the live conductive electrode bar 440 and the neutral conductive electrode bar 450 is the same conductive electrode bar as shown in FIG. 5. The double-sided multi-socket adapter panel 400 further includes a housing 410, a conductive earthing bar 460, a cut-off switch 470 and an extension plug 480.

Figure 2:
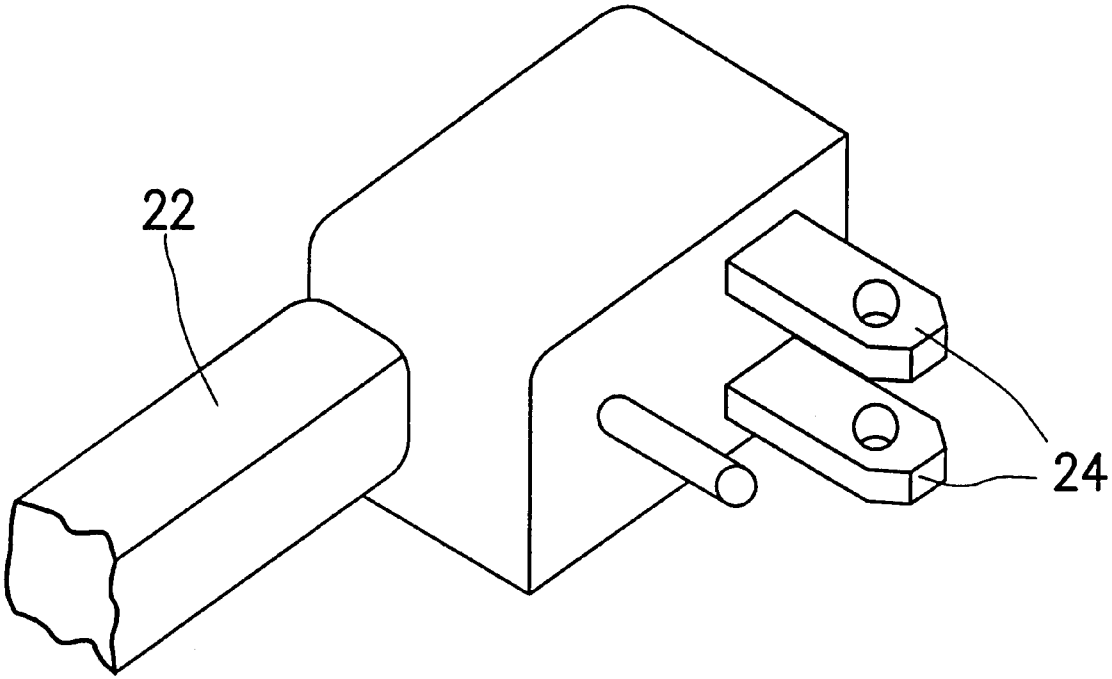
FIG. 2 (PRIOR ART)
FIG. 2 is the perspective view of a plug whose cable forms a 90° bent with the electrode pins.

The housing 410 is assembled from two half-panels 420 and 430 to form a smooth rectangular compartment. On the inner surface of the half-panels 420, there are four plugging sockets 422*a* to 422*d* each comprising a plugging slot for live electrode 424*a*, a plugging slot for neutral electrode 424*b* and a plugging slot for earth 426. In addition, the respective plugging slots 424*a*, 424*b* and 426 of the plugging sockets 422*a* to 422*d* are aligned along the same layout direction as the plugging sockets 422*a* to 422*d*. Hence, even when all the plugging sockets 422*a* to 422*d* are plugged, since all the plugs are in parallel to each other, there will be no interference between plugging cables of neighboring plugging sockets. The advantages are more obvious when a plug such as the one shown in FIG. 2 is used. Distance of separation between each of the plugging sockets 422*a* to 422*d* are comparable to the plugging socket 34 as shown in FIG. 3, and generally can be used for general plug-in situation. The distance of separation between plugging sockets 422*b* and 422*c* is made slightly larger, and hence able to accommodate a plugging socket 432*b* on the other side of the panel. In addition, region outside the plugging sockets 422*a* and 422*d* are unoccupied, therefore, another two plugging sockets 432*a* and 432*c* for the other side of the panel can be accommodated. Consequently, each of the three plugging sockets 432*a* to 432*c* are widely separated from each other, and thus can be used for plugging exceptionally large plugs such as a transformer adapter. Similarly, the respective plugging slots for live, neutral and earth 434*a*, 434*b* and 436 of the plugging sockets 432*a* to 432*c* are aligned along the same layout direction as the plugging sockets 432*a* to 432*c*. Furthermore, there is a protective cover 428 above each of the plugging sockets 422*a* to 422*d* and 432*a* to 432*c*. The protective cover 428 snapped-in to the grooves on each side of a plugging cavity is able to slide so that any one of the unused plugging sockets 422*a* to 422*d* and 432*a* to 432*c* can be shut. The cover is able to cover the electrode and the earth plugging slots completely, thereby preventing dust from entering the socket as well as accidental touching of the live terminals.

The live conductive electrode bar 440 and the neutral conductive electrode bar 450 is fixed inside the housing 410. In general, the bars are made from copper material. Properly fabricated live and neutral conductive electrode bars 440 and 450 have conductive electrode plates 442 along the bar located in such positions as to match the corresponding electrode plugging slots. Consequently, each of the respective electrode plugging slot 424*a*, 424*b*, 434*a* and 434*b* of each plugging sockets 422*a* to 422*d* and 432*a* to 432*c* has an electrode plate 442 in it.

The earthing conductive bar 460 is also fixed inside the housing 410, and is generally made from copper. Design of the earth conductive bar 460 is structurally quite simple. Any structure that can provide a caved-in guiding hole 464 in each position that corresponds to the plugging slots 426 and 436 of the plugging sockets 422*a* to 422*d* and 432*a* to 432*c* is feasible. Obviously, if no earthing connections for the plugging sockets are required, the earthing conductive bar 460 in unnecessary.

The cut-off switch 470 is located at one end inside the housing 410 avoiding positions where the plugging sockets 422*a* to 422*d* and 432*a* to 432*c* are occupied. Therefore, height of the cut-off switch 470 will not affect the uniform outward appearance of the housing 410. The cut-off switch 470 can also include a power source indicator light that shows the on/off state of the adapter panel 400. However, whether an indicator light is present on the cut-off switch 470 or not, an extra protective cover 438 for enclosing the indicator light can be form on the surface of the half-panel 430.

The other end of the extension cable 480 is connected to a circuit board 482 having circuits in it (not drawn). The circuit board 482 links up the two conductive electrode bars 440 and 450, the earthing bar 460 and the cut-off switch 470, and supplies the necessary electric power for the adapter panel 400.

Figure 7:
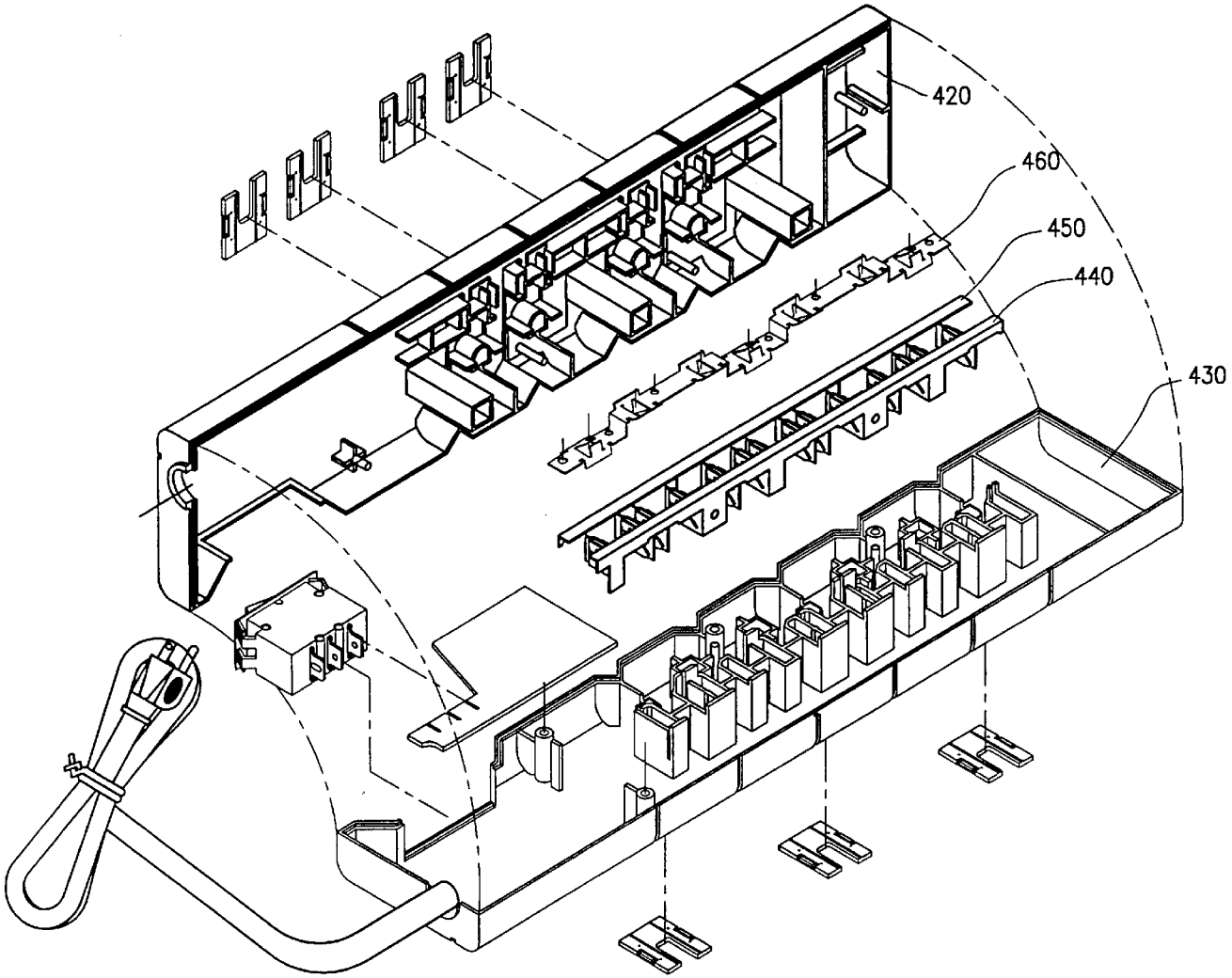
FIG. 7 is a detailed perspective view of FIG. 6 showing two half-panels of the adapter panel housing split-opened to see the internal structures for holding the conductive electrode bars and the earthing bar.
Figure 8:
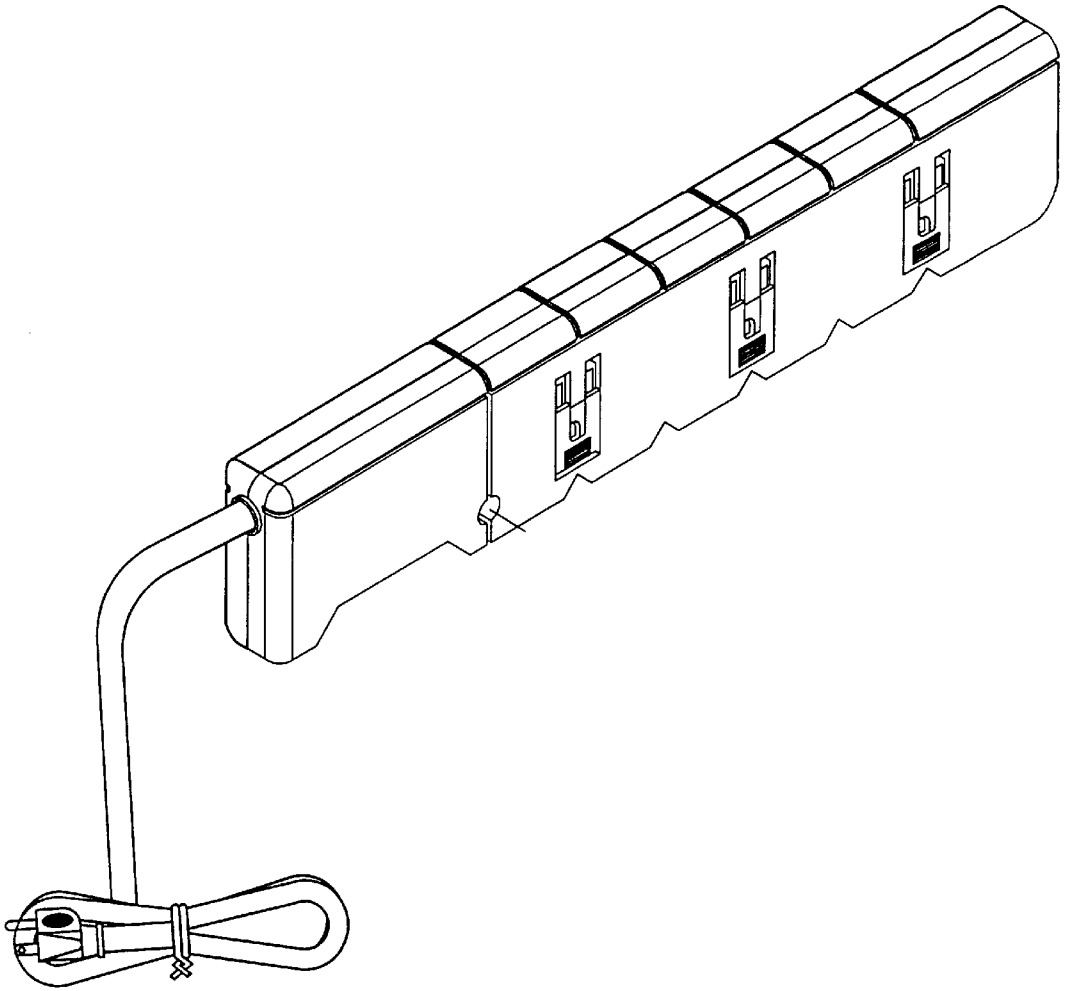
FIG. 8 is a perspective view showing the assembled double-sided multi-socket adapter panel according to this invention.

FIG. 7 is a detailed perspective view of FIG. 6 showing two half-panels of the adapter panel housing split-opened to see the internal structures for holding the conductive electrode bars and the earthing bar. Utilizing the intricate grids inside the half-panels 420 and 430 formed by an injection molding process, the conductive electrode bars 440 and 450 as well as the earthing bar 460 can be securely fixed inside the housing 410. After proper assembling procedures, a double-sided multi-socket adapter panel as shown in FIG. 8 is obtained.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A conductive electrode bar structure for a double-sided multi-socket adapter panel having a plurality of plugging sockets on each side, wherein a respective pair of live and neutral plugging slots of each of the plurality of plugging sockets are aligned in a single row, and a distance of separation for some of the neighboring sockets are so far apart that even a large size plugging head can be plugged into the socket without affecting the usability of adjacent sockets, the conductive electrode structure comprises:

a live conductive electrode bar fixed inside the double-sided multi-socket adapter panel, wherein the live conductive electrode bar comprises a plurality of live electrode plates located at such a position that each live plugging slot of the electrode plugging slots has one live electrode plate inside, and the live electrode plate is so constructed that when a plug is plugged into the plugging socket, a live plugging pin of the plug can make proper contact with the live electrode plate; and a neutral conductive electrode bar fixed inside the double-sided multi-socket adapter panel, wherein the neutral conductive electrode bar comprises a plurality of neutral electrode plates located at such a position that each neutral plugging slot of the electrode plugging slots has one neutral electrode plate inside, and the neutral electrode plate is so constructed that when the plug is plugged into the plugging socket, a neutral plugging pin of the plug can make proper contact with the neutral electrode plate, wherein the live and neutral electrode plates of each socket are aligned with the single row.

2. The structure of claim 1, wherein the live electrode plate is formed by a punching process, and has a structure that includes two side strips formed in a manner such that each side strip has a central bulging section, wherein the central bulging section defines an opening capable of fitting the live plugging pin of a plug tightly inside.

3. The structure of claim 1, wherein the neutral electrode plate is formed by a punching process, and has a structure that includes two side strips and a central bulging section, where the central bulging section encloses a hollow defined by the volume between two side strips and the central bulging section and where the hollow is located and sized to receive the neutral plugging pin of the plug to form an electrical connection with the plug.

4. The structure of claim 1, wherein the live electrode plate structure and the neutral electrode plate structure is the same.

5. A conductive electrode bar structure for a double-sided multi-socket adapter panel having a plurality of plugging sockets on each side with each socket having a pair of electrode plugging slots, wherein the pair of electrode plugging slots of each socket are aligned with one another in a row, wherein a first socket is separated from an adjacent socket by a distance sufficient to permit a large transformer adapter to be plugged into the first socket without affecting the usability of the adjacent socket, the conductive electrode structure comprises:

a live conductive electrode bar fixed inside the double-sided multi-socket adapter panel, wherein the live conductive electrode bar comprises a plurality of live electrode plates located at such a position that each live plugging slot of the electrode plugging slots has one live electrode plate inside, the live electrode plate is formed by a punching process, and has a structure that includes two side strips formed in a manner such that each side strip has a central bulging section, wherein the central bulging section defines an opening; and a neutral conductive electrode bar fixed inside the double-sided multi-socket adapter panel, wherein the neutral conductive electrode bar comprises a plurality of neutral electrode plates located at such a position that each neutral plugging slot of the electrode plugging slots has one neutral electrode plate inside, the neutral electrode plate is formed by a punching process, and has a structure that includes two side strips formed in a manner such that each side strip has a central bulging section wherein the central bulging section defines an opening capable of fitting the neutral plugging pin of the plug tightly inside.

6. A double-sided multi-socket adapter panel comprising:

a housing assembled from two opposing half-panels and forming a smooth rectangular external shape, each half-panel having a plurality of plugging sockets each having two electrode-plugging slots and one earth-plugging slot, the plugging sockets alternating between each side of the adapter panel such that the plugging sockets on one half-panel are spaced further apart and capable of plugging in even a transformer adapter plug without interfering with the use of neighboring sockets, in addition, all the electrode-plugging slots on each half-panel are aligned along a single straight line;

two conductive electrode bars fixed inside the housing, comprising a plurality of electrode tooth-plates, the tooth-plates being positioned such that there is one electrode tooth-plate inside each electrode-plugging slot of every plugging socket, the two conductive electrode bars comprising first and second elongate conductive electrode bar each having a plurality of electrode tooth-plates perpendicular to a longitudinal axis of the bar, the electrode tooth-plates of each bar being arranged with a periodical pattern, the first bar being live and the second bar being neutral, the bars being parallel with the second bar rotated 180° relative to the first bar and with the electrode tooth-plates of both bars interleaved, the electrode tooth-plates of each electrode bar being close to, but not in electrical contact with, the opposite electrode bar so that all the electrode tooth-plates from both electrode bars are aligned along the same straight line, the periodical pattern being selected so that the tooth-plates repeat on each bar with a pattern of AAB, where A is a longer spacing and B is a shorter spacing; and an earth conductive bar fixed inside the housing with a pin-receiving socket in each position that corresponds to the earth-plugging slots of the plugging sockets.

7. A double-sided multi-socket adapter panel comprising:

a housing assembly having opposing first and second sides with each side having a plurality of plugging sockets on both the first and second sides and in alternating locations, the sockets each having two electrode-plugging slots and one earth-plugging slot with the electrode-plugging slots being arranged along a first straight line and the earth plugging slots being located along a second, parallel line;

two conductive electrode bars fixed inside the housing, one neutral and one live, each of the conductive electrode bars having a plurality of electrode tooth-plates connected with the bar, each tooth-plate having opposing side strips spaced apart to form a hollow that is sized to receive and electrically engage a pin of an electrical plug, the electrode bars each having an elongated length, the bars being parallel and having the tooth-plates of each bar extending toward the other bar, the two bars each having the tooth-plates connected to the bars at corresponding locations on the bars but with one bar rotated 180° relative to the other bar and the tooth-plates interleaved with those of the other bar to form pairs of live and neutral tooth plates located to correspond with the electrical plugging slots; and an earth conductive bar fixed in the housing and parallel to the other conductive bars, the earth conductive bar having a plurality of openings along a length of the earth conductive bar, the openings being sized to receive and electrically engage a ground pin of an electrical plug and located to correspond with the earth plugging slots of the socket adapter panel.

8. A method of forming a double-sided multi-socket adapter panel that reduces the material used for electrical connections in the panel, comprising the steps of:

providing a housing assembly with opposing first and second sides and placing a plurality of plugging sockets on both the first and second sides and in alternating locations, providing each socket with two electrode-plugging slots and one earth-plugging slot and arranging the electrode-plugging slots along a first straight line and arranging the earth plugging slots along a second, parallel line;

providing a neutral conductive bar and a live conductive bar, and placing a plurality of electrode tooth-plates on each bar at corresponding locations on the other bar to form a plurality of neutral tooth-plates on the neutral conductive bar and a plurality of live tooth-plates on the live conductive bar, and providing each of the electrode tooth-plates with opposing side strips spaced apart to form a hollow that is sized to receive and electrically engage a pin of an electrical plug;

placing the conductive bars parallel to each other with the tooth-plates of each bar extending toward the other bar but with a length of one bar rotated 180° relative to the other bar so as to interleave the tooth-plates of each bar to form pairs of live and neutral tooth plates located to correspond with the electrical plugging slots;

fixing the bars inside the housing so that the pairs of live and neutral tooth plates correspond with the electrical plugging slots;

fixing an earth conductive bar in the housing and parallel to the other conductive bars, and providing a plurality of openings along a length of the earth conductive bar with the openings being sized to receive and electrically engage a ground pin of an electrical plug and locating the openings to correspond with the earth plugging slots; and fixing the earth conductive bar inside the housing so the openings correspond with the earth plug slots.

* * * * *